United States Patent [19]

Peterson

[11] 4,044,411

[45] Aug. 30, 1977

[54] TRANSPORTABLE FOLDING CRIB

[76] Inventor: Jerald G. Peterson, Apt. 11C Northgate Square, Reston, Va. 22090

[21] Appl. No.: 609,006

[22] Filed: Aug. 29, 1975

[51] Int. Cl.[2] ..... A47C 29/00

[52] U.S. Cl. ..... 5/99 A; 190/2

[58] Field of Search ..... 5/98 R, 98 A, 98 B, 5/99 A, 99 B; 190/2, 1, 12; 248/461; 135/4 R

[56] References Cited

U.S. PATENT DOCUMENTS

| | | | |
|---|---|---|---|
| 2,531,501 | 11/1950 | Cline | 190/1 |
| 2,738,521 | 3/1956 | Billgren | 5/99 R |
| 2,804,083 | 8/1957 | Wieber | 135/4 R |
| 2,908,021 | 10/1959 | Fulton | 5/98 R X |
| 2,960,993 | 11/1960 | Holmstrom | 135/4 R |
| 3,009,471 | 11/1961 | Rossiter | 5/119 X |
| 3,028,871 | 4/1962 | Clift | 135/4 R X |
| 3,162,460 | 12/1964 | Davidson | 5/99 R X |
| 3,669,227 | 6/1972 | Alford | 248/461 |
| 3,847,462 | 11/1974 | Repetti | 312/330 R |

*Primary Examiner*—Paul R. Gilliam

*Assistant Examiner*—Andrew M. Calvert

*Attorney, Agent, or Firm*—Witherspoon, Lane & Hargest

[57] ABSTRACT

A portable folding crib housed in a suitcase or similar piece of luggage is disclosed. In the basic embodiment, the crib-suitcase combination is so constructed that a majority of the total volume of the suitcase is preserved as two compartments for storing the crib mattress, clothing, and the like. Each of the two compartments is covered by a separate hinged door, the two doors forming the floor of the crib when the crib is erected. The crib structure when folded fits around the storage compartments which are covered by the hinged doors. When folded and closed, the structure has the appearance of an ordinary suitcase and is as readily transportable as the average packed suitcase. To utilize the crib, one fully opens the suitcase and unfolds the crib into its erected position. No mechanical skill or special tools are necessary to unfold or refold the crib. In addition to the basic embodiment, several additional embodiments of the invention are disclosed.

17 Claims, 16 Drawing Figures

TRANSPORTABLE FOLDING CRIB

BACKGROUND OF THE INVENTION

This invention relates to folding cribs; and more particularly, to a folding crib structure constructed in a suitcase or similar piece of luggage.

A problem that has continuously confronted the parents of infants is the problem of providing adequate and safe bed facilities for the infant when traveling, particularly when visiting friends or relatives who do not have a crib, a playpen, or the like. To solve this problem, parents generally purchase folding playpens or one of the several different types of folding cribs available on the market. While these playpens and cribs can be folded when not in use, they are even in the folded state rather bulky and not readily transportable other than by private automobile. Even when traveling by automobile these prior art cribs are not easily transported since they take up a large amount of space in the automobile. When traveling by bus, plane or train, it is practically impossible to take along these prior art cribs or playpens.

This invention overcomes the problem of providing a crib for an infant when traveling. The crib structure of this invention is as easily transported as any piece of luggage and has the appearance of an ordinary suitcase when folded and closed. Further, the overall weight of the structure is comparable to a light packed suitcase.

SUMMARY OF THE INVENTION

A folding crib which is constructed into a suitcase is disclosed. In the basic embodiment, two compartments each covered by a hinged door are provided inside the suitcase. The crib structure when folded fits between the two compartments and the sides of the suitcase. The compartments are used to store the crib mattress, infant's clothing, and the like. To erect the crib, one merely fully opens the suitcase and raises the crib structure to its erected position. No special mechanical skill or tools are necessary to erect and take down the crib. A latch arrangement is provided to latch the suitcase in the open position when using the crib.

In a variation of the basic embodiment, the hinged doors are recessed and the mattress is detachably mounted to the doors in both the erect and folded positions. This arrangement decreases the storage space but eliminates a pair of zippers utilized in the basic embodiment.

In a third embodiment of the invention, the compartments are eliminated entirely. This decreases the overall size of the structure in the folded and closed position, thereby providing a thinner suitcase at the expense, however, of the loss of storage space.

A fourth embodiment of the invention is similar to the basic embodiment. However, this embodiment is constructed as an insert for a suitcase. Thus, if parents already own a suitable suitcase, they can purchase the insert and insert it into the suitcase with but a slight modification of the suitcase. By the same token, when the crib is no longer needed, the insert can be removed. Of course, one can also remove the crib structure in the embodiments where the suitcase and crib are manufactured as a unit but not as readily as in the case of the insert embodiment.

BRIEF DESCRIPTION OF THE DRAWING

The exact nature and structural details of the invention will become readily apparent from the following detailed description of the invention when read in conjunction with the annexed drawing in which.

DETAILED DESCRIPTION OF THE INVENTION

Figure 1:
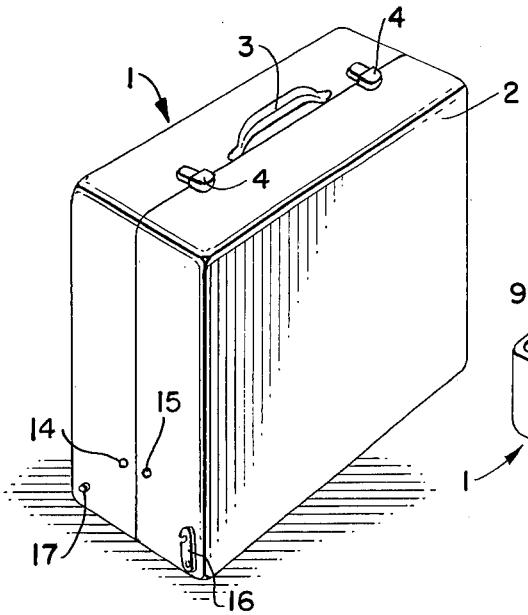
FIG. 1 shows the basic embodiment of the crib-suitcase of this invention with the crib folded and the suitcase closed.
Figure 2:
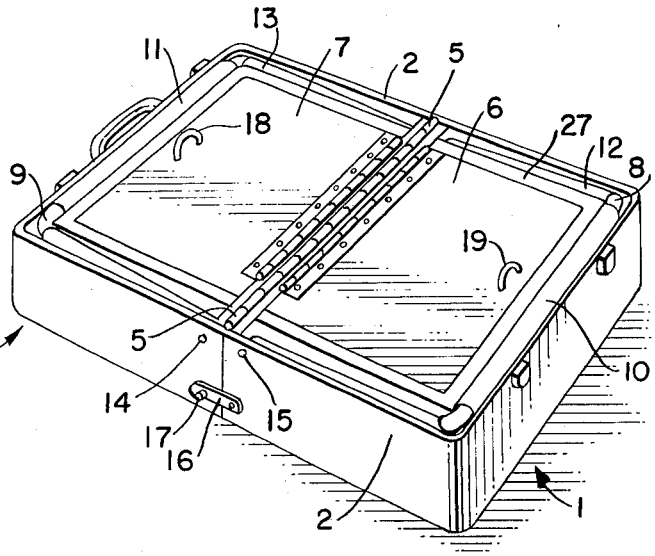
FIG. 2 shows the suitcase of FIG. 1 in the open position with the crib folded.

FIG. 1 shows the basic embodiment of the crib-suitcase combination with the crib folded and the suitcase closed. As is apparent from FIG. 1, the crib-suitcase combination has the outward appearance of a suitcase 1 with the handle 3 and the latches 4. However, when suitcase 1 is opened as in FIG. 2, it is apparent that suitcase 1 is not just an ordinary suitcase. Suitcase 1 is provided with a standard piano type hinge 5 and a pair of hinged doors 6 and 7 are located inside suitcase 1 as shown in FIG. 2. When suitcase 1 is fully opened, a latch arrangement consisting of the latch arm 16 and the latch pin 17 is latched to lock suitcase 1 in the open position.

Figure 3:
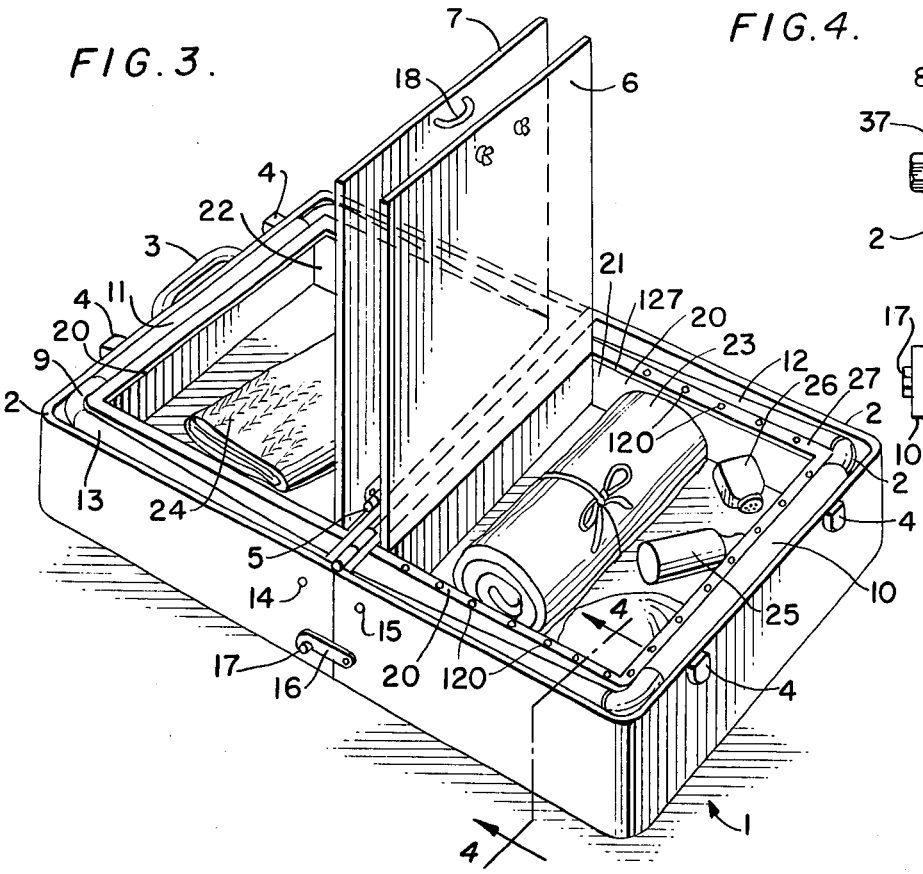
FIG. 3 shows the hinged doors of the FIG. 2 embodiment in the raised position to show the storage compartments.

Referring to FIG. 3, a compartment 21 is located beneath hinged door 6 and a compartment 22 is located beneath hinged door 7. Compartments 21 and 22 are used to store items such as the crib mattress 23, the blanket 24, the bottle 25, the powder container 26 and other infant items such as clothing and the like (not shown). Hinged doors 6 and 7 are provided with the pull strings 19 and 18 or suitable recessed handles respectively to raise these doors to gain access to compartments 21 and 22.

Figure 4:
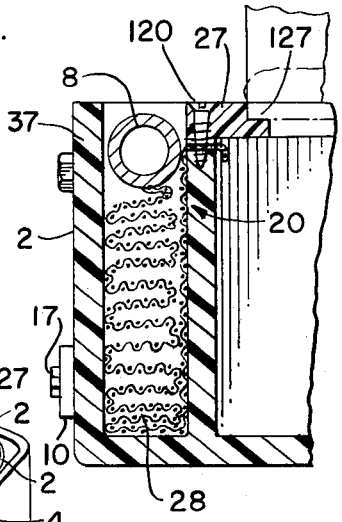
FIG. 4 is a cross-section showing how the crib is stored in the folded position and how the crib wall attaches to the storage compartments.

Suitcase 1 has an outer wall structure 2 and an inner wall structure 20, as is more clearly shown in FIG. 4. Inner wall 20 is, of course, formed in two parts or halves as is outer wall structure 2. Each half or part of inner wall 20 has an attached door frame 27 with a ledge 127 formed therein to support hinged doors 6 and 7. As is more apparent in FIG. 4, outer wall structure 2 and inner wall structure 20 are spaced apart to form a space into which the crib walls and rods fit when the crib is folded. FIG. 4 shows a part of the crib rod 8 and a part of crib wall 28 in the folded position. FIG. 4 also shows the bottom edge of the crib wall 28 attached to the inner wall 20 by sandwiching it between the top edges of inner wall 20 and the door frame 27 which is secured to the inner wall 20 by screws 120 or the like. While not as apparent as in FIG. 4, FIGS. 2 and 3 also show that outer wall structure 2 and inner wall structure 20 are spaced apart to form a space into which the crib is stored when folded. In FIGS. 2 and 3 only the crib support rods 8 and 9 and the sleeves 10 and 11 of the crib are visible.

Figure 5:
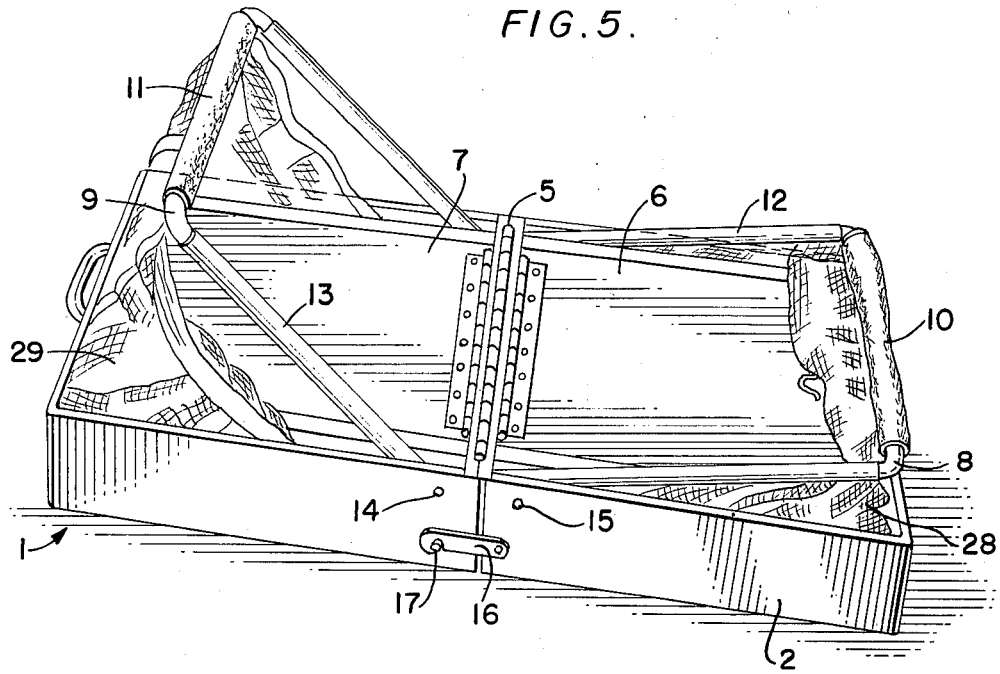
FIG. 5 shows the crib of the basic embodiment being raised.

In order to raise the crib into its upright or erect position, crib rods 8 and 9 are pulled out of the space formed by outer wall structure 2 and inner wall structure 20 by pulling rods 8 and 9 upward and toward the center of suitcase 1 as shown in FIG. 5. Crib rods 8 and 9 are pivotally secured to outer wall structure 2 and/or inner wall structure 20 on both sides of suitcase 1 by any suitable means such as the pins 14 and 15. An identical pair of pins are, of course, provided on the other side of suitable 1. Any suitable means can be used to secure rods 8 and 9 to suitcase 1; the only limitation being that the means used must permit crib rods 8 and 9 to pivot.

Figure 16:
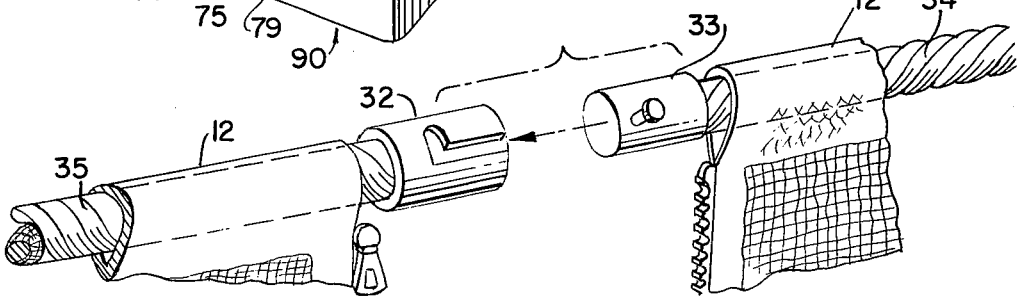
FIG. 16 shows a preferred latch arrangement used on the crib of the basic embodiment.

Crib rods 8 and 9 which are U-shaped from the basic support structure for the crib when it is in its erected position. In this embodiment the wall structure that is the sides and ends of the crib are formed by the two crib wall sections 28 and 29. Crib walls 28 and 29 may be made from nylon mesh, for example, or any other suitable material that can be folded. Crib wall 28 is secured to rod 8 by means of sleeve 10 and crib wall 29 is secured to crib rod 9 by means of sleeve 11. Sleeve 12 extends around the entire top part of crib wall 28, passing beneath rod 8 and sleeve 13 extends around the entire top part of crib wall 29, passing beneath crib rod 9. Sleeve 12 is, of course, secured to sleeve 10 where it passes under rod 8 and sleeve 13 is secured to sleeve 11 where it passes under rod 11. As previously mentioned, crib walls 28 and 29 are secured at the bottom to inner wall 20 as shown in FIG. 4. The rope 34 (FIGS. 6 and 16) is encased by sleeve 12 and a similar section of rope, the rope 35 (FIG. 16) is encased by sleeve 13. Any suitable rope can be used by nylon or other soft, strong rope is preferable. Robe 34 has a male fitting 33 secured to each of its ends. This fitting is more clearly shown in FIG. 16. Rope 35 has a female fitting secured to each of its ends; this fitting is also more clearly shown in FIG. 16.

Figure 6:
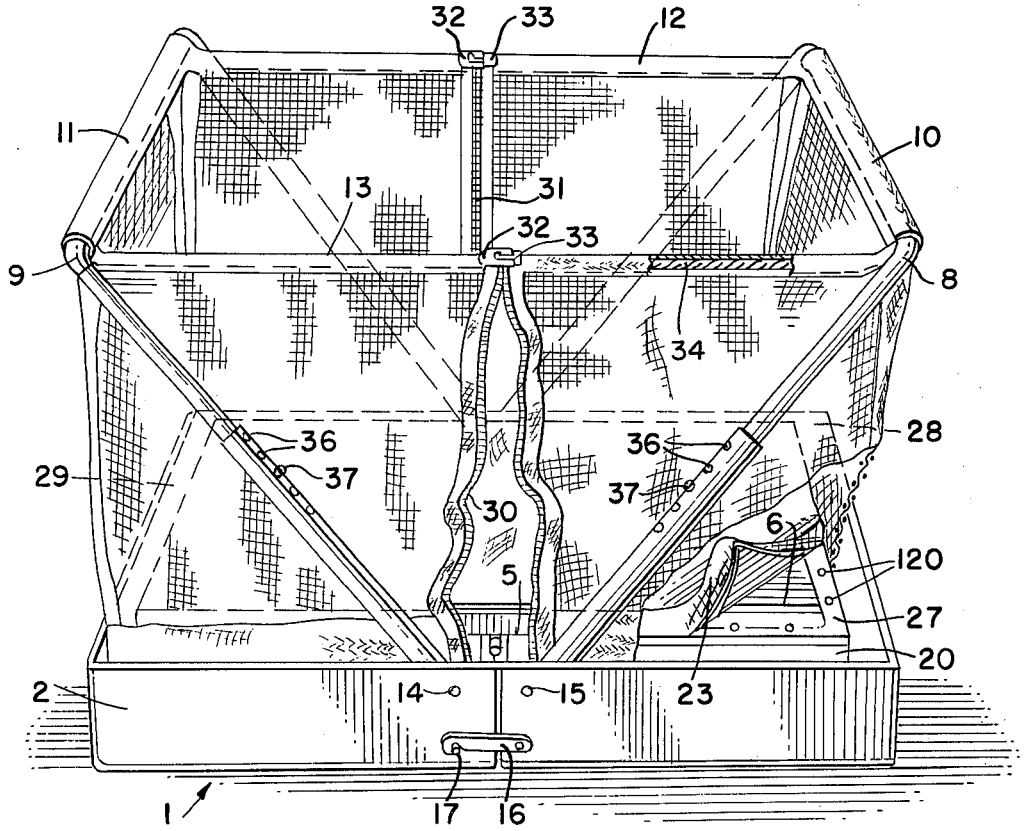
FIG. 6 shows the crib of the basic embodiment in its raised position with the crib mattress placed over the hinged doors.
Figure 7:
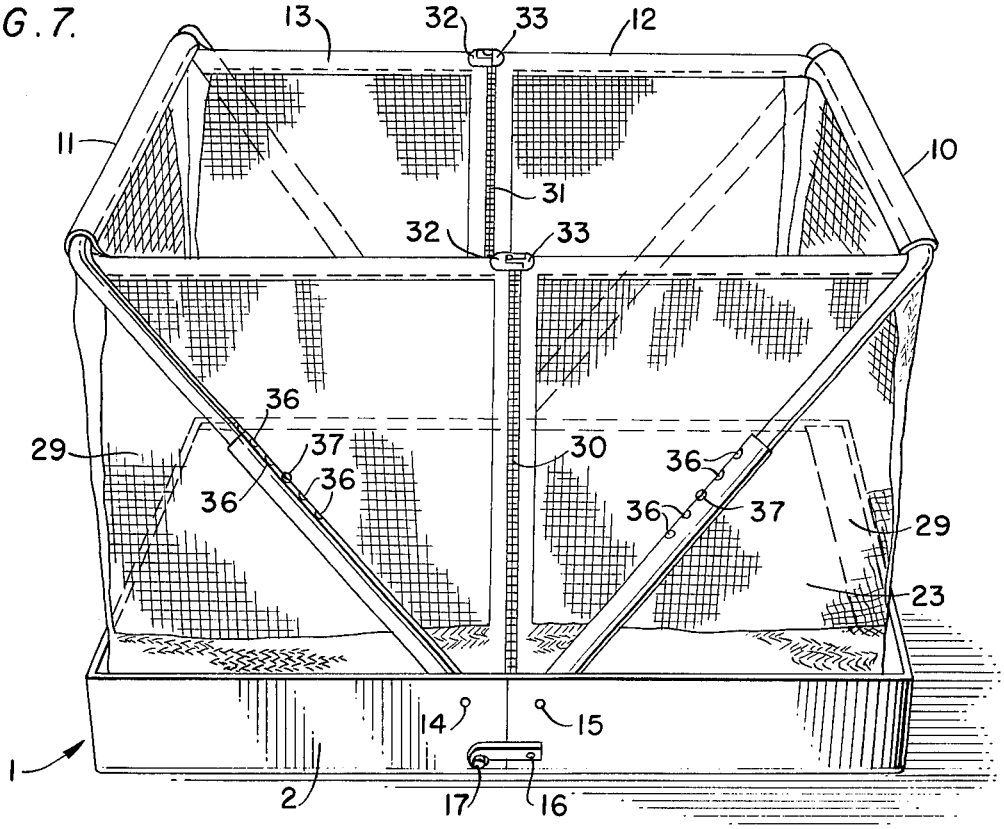
FIG. 7 shows the crib in its fully raised and erected position.
Figure 13:
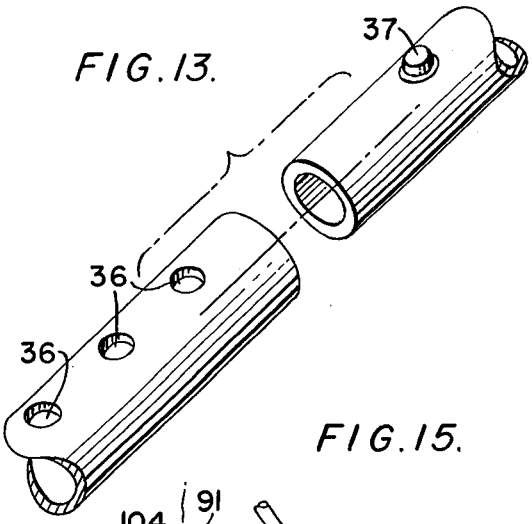
FIG. 13 shows a preferred latching arrangement for the crib rods of all the embodiments of the invention.

After crib rods 8 and 9 have been raised out of the spaces formed by outer wall structure 2 and inner structure 20 and pivoted, the ropes 34 and 35 are joined by locking female fittings 32 onto male fitting 33. How these fittings are joined and secured to each other is obvious from FIG. 16. FIG. 6 shows fittings 32 and 33 engaged. After ropes 34 and 35 are joined as described, crib rods 8 and 9 are extended to pull crib walls 28 and 29 taut. Crib rods 8 and 9 are telescoping rods with one part of the telescoping sections of each rod being provided with a plurality of holes 36 and the other section of each rod being provided with a spring biased button 37. This hole and button structure which is more clearly shown in FIG. 13 is a conventional structure often used with telescoping rods to lock telescoping rods into position. Thus, crib rods 8 and 9 are extended to make crib walls 28 and 29 as tight as possible but to a position that lines up button 37 of each rod with one of the holes 36 of each rod so that rods 8 and 9 are locked into the extended position. A zipper 30 and a zipper 31 are provided to join the crib walls 28 and 29. When rods 8 and 9 have been extended, zippers 30 and 31 are zipped shut to form the completely erected crib as shown in FIG. 7. Mattress 23 is spread across doors 6 and 7 to cover doors 6 and 7 and to provide a soft bed for the infant.

Figure 8:
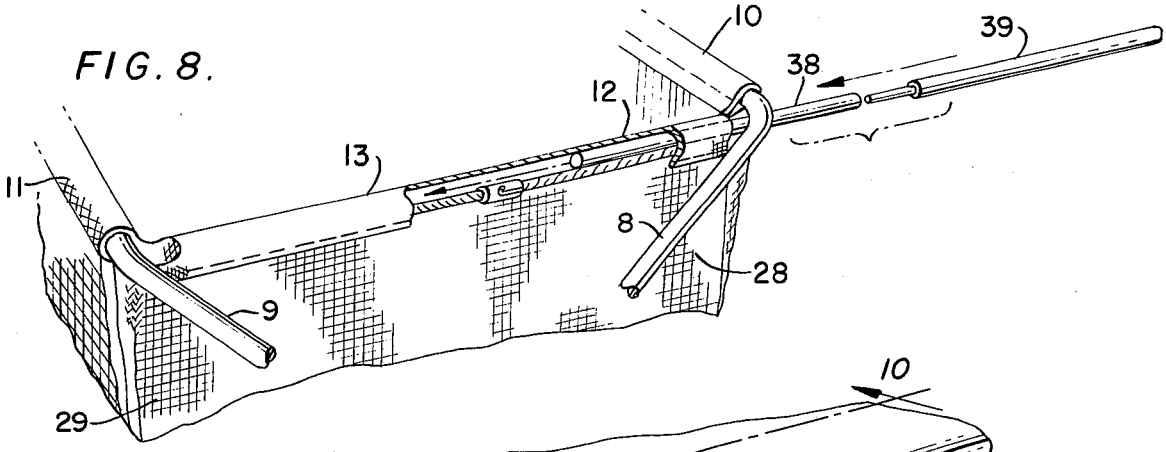
FIG. 8 shows an optional strengthening bar that may be used with any of the embodiments of the invention.

While the structure has been called a crib, it is obvious from FIG. 7 that the structure can also serve as a conventional playpen. When in the fully erected position, ropes 34 and 35 inside sleeves 12 and 13 are fairly taut. However, if the child is old enough to pull himself erect, these ropes will sag somewhat in the area where the child is pulling. While this should not create any problem, it may be desirable to stiffen the top of the crib along its length. FIG. 8 shows a method for stiffening the top of the crib along its length. Sleeves 12 and 13 (sleeve 12 only being shown in FIG. 8) are made sufficiently large to accommodate ropes 34 and 35 respectively and in addition to accommodate the rod 38 which may for convenience of storage be a two piece rod as shown in FIG. 8. Rod 38 is merely slipped into each sleeve 12 and 13 thereby stiffening the top of the crib along its length. Enlarging of the sleeves 12 and 13 and the use of rods 8 is optional. The use of such rods is not required. Instead of enlarging sleeves 13 and 14 to accommodate a rod 38, two separate sleeves could be used.

To fold up the crib of FIG. 7, one merely unzips zippers 30 and 31, retracts rods 8 and 9 by pushing in the buttons 37, uncouples female coupler 32 from male coupler 32, pushes rods 8 and 9 and walls down into the spaces between outer wall structure 2 and inner structure 20, folds up mattress 23 and stores it in one of the compartments 21 and 22, unlatches latch arm 16 from latch pin 17 and closes up suitcase 1. Thus, it is apparent that erecting and taking down of the crib of this invention is readily accomplished without the need of special tools.

Figure 9:
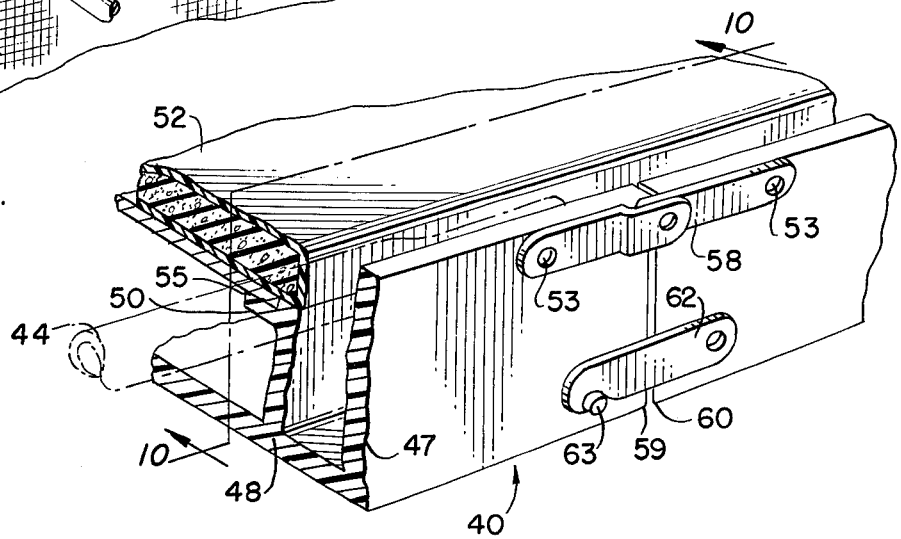
FIG. 9 is a sectional view showing a recessed door variation of the basic embodiment of the invention.
Figure 10:
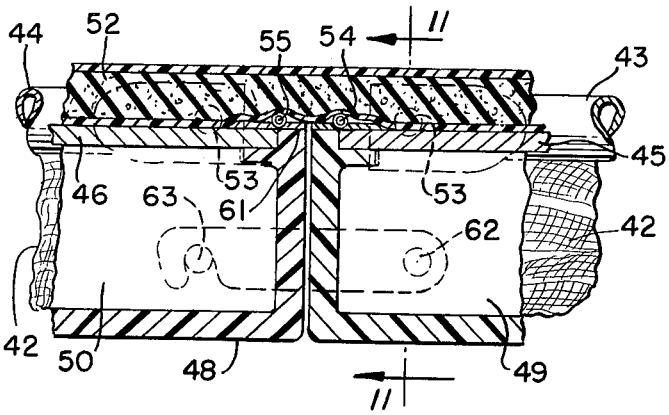
FIG. 10 is a further section view of the recessed door variation of the invention.
Figure 11:
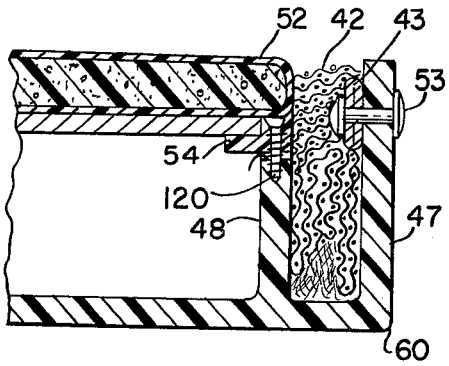
FIG. 11 is still another section view of the recessed door variation of the invention.
Figure 12:
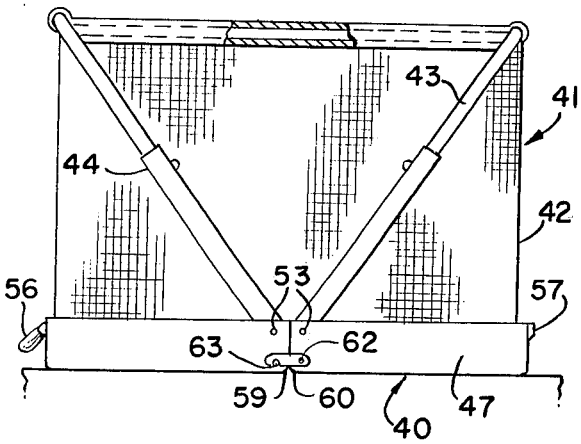
FIG. 12 shows the crib of the recessed door variation in its fully erected position.

FIGS. 9, 10, 11 and 12 shows a variation of the basic embodiment illustrated in FIGS. 1 through 7. Referring first to FIG. 12, the overall appearance of this variation is, of course, similar to the overall appearance of the basic embodiment and includes a suitcase 40 and the crib structure 41. However, in the variation the crib wall 42, which may also be of nylon mesh or the like, is not separated into two halves. That is, zippers 30 and 31 provided in the basic embodiment are not needed in the embodiment. Crib wall 42 does not need to be split into two halves to store the crib because the hinged doors 45 and 46 (only a part of hinged doors 45 and 46 are shown in FIGS. 9, 10 and 11) which form the floor of the crib are recessed (see FIGS. 9 and 11). Suitcase 40, as in the basic embodiment, has an outer wall structure 47 and an inner wall 48 spaced apart from outer wall structure 47. The area between inner wall structure 48 and outer wall structure 47 and the space between the mattress 52 and outer wall structure 47, created by recessing inner wall structure 48 are utilized to store crib 41 in its folded position. The additional space, as compared to the basic embodiment, provided between outer wall structure 47 and mattress 52 is sufficient to accommodate crib 41 in its folded position without splitting crib wall 42 in the manner in which the crib wall structure of the basic embodiment is split.

Crib 41 in addition to wall structure 42 includes the telescoping rods 43 and 44. Telescoping rods 43 and 44 are provided with the hole and button arrangement of FIG. 13 to hold these rods in their telescoped position and are pivotally secured at each end to outer wall structure 47 by means of a nut and bolt arrangement 53 (FIG. 11) or by any other suitable means that will permit rods 43 and 44 to pivot so that crib 41 can be erected and taken down.

In the closed position, hinged doors 45 and 46 rest on the ledges 54 and 55 respectively of inner wall structure 48. Hinged door 45 is hinged by means of the hinge 54 and hinged door 46 is hinged by means of the hinge 55. Doors 45 and 46 are hinged to provide access to the compartments 49 and 50 respectively. Since doors 45 and 46 are recessed, compartments 49 and 50 are smaller in volume than the equivalent compartments of the basic embodiment. Thus, while this variation does eliminate the zippers 30 and 31 of the basic embodiment, it does so at a sacrifice of compartment space. Some of this lost space is retrieved since mattress 52 remains on top of doors 45 and 46. That is, mattress 52 is not stored in one of the compartments 49 and 50 when crib 41 is folded and suitcase 40 is closed. Thus, mattress 52 can be secured to doors 45 and 46 but is preferably removably secured to doors 45 and 46 so that it can be removed to facilitate cleaning of the mattress.

Snaps or closures are of course provided to hold suitcase 40 closed when crib 41 is folded and suitcase 40 is closed. Only one of the snap or closure arrangements, the snap arrangement comprising the two parts 56 and 57, is shown in the drawing (FIG. 12). Instead of a piano hinge, suitcase 40 is provided with a pair of knife hinges 58, only one of which is shown in the drawing (see FIG. 9). With this hinge arrangement and with mattress 52 remaining on doors 45 and 46, there is a gap at the bottom of suitcase 40 when suitcase 40 is closed. That is the edges 59 and 60 of the two sections of outer wall structure 40 do not abut when suitcase 40 is closed. In order to cover this gap, a piece of flexible material 61 is provided (FIG. 10). A latch arrangement comprising a latch arm 62 and a latch pin 63 is provided to lock suitcase 40 in the open position. This latch arrangement can be and preferably is identical to the latch arrangement provided in the basic embodiment.

Figure 14:
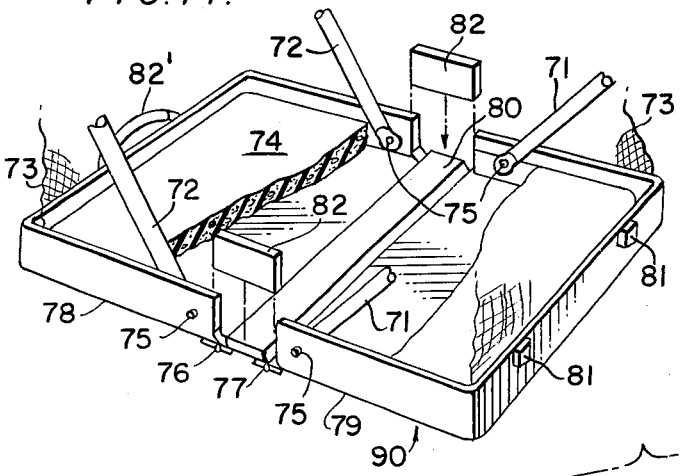
FIG. 14 shows a third embodiment of the invention.

FIG. 14 shows a third embodiment of the invention. This embodiment also comprises a suitcase 70 having a crib contained therein. Only a part of the crib structure is shown since this crib structure is identical to crib 41 of FIG. 12. Thus, the crib of the FIG. 14 embodiment comprises the crib support rods 71 and 72 only part of which are shown, the one piece crib wall 73 made from nylon mesh or the like, again only a part of this is shown in FIG. 14. Obviously, the bottom edge of crib wall 73 is attached under the mattress 74 to the outer edges of the bottom of suitcase 70 by any suitable means such as screws or glue (not shown). In the folded away position, the crib wall 73 spreads and rests on top of crib mattress 74 (not shown). Support rods 71 and 72 are, of course, telescoping rods having the hole and button locking arrangement shown in FIG. 13. Any suitable means such as the pins 75 can be used to pivotally secure rods 71 and 72 to suitcase 70.

In this third embodiment, no storage compartments are provided. Instead, the bottom of suitcase 70 when suitcase 70 is fully opened as in FIG. 14 serves as the bottom or floor of the crib. The mattress 74, only a part of which is shown in FIG. 14 is spread out inside suitcase 70. Mattress 74 is of such size that it covers the entire width and length of the inside suitcase 70 not occupied by rods 71 and 72 in their folded away position along the outer edges of suitcase 70. Suitcase 70 has a pair of piano hinges 76 and 77. Hinge 76 is secured to side 78 of suitcase 70 and to the center piece 80 of suitcase 70. Similarly, hinge 77 is secured to side 79 of suitcase 70 and to the center piece 80. Suitcase 70 is provided with the conventional latches, only half of which, the halves 81 secured to side 79, are shown and with a conventional carrying handle 82'.

As is shown from FIG. 14, suitcase 70 is so constructed that there is a gap between side 78 and 79 when suitcase 70 is fully opened: This gap is, of course, caused by the manner in which suitcase 70 is constructed. This particular construction using center piece 80 is, of course, necessary to provide a flat crib bed. The blocks or wedges 82 which are stored inside suitcase 70 when the crib is not in use and suitcase 70 is closed are provided to close the gaps in suitcase 70 and in addition serve to lock suitcase 70 in the open position.

While this third embodiment of the invention does not provide storage compartments for storing infant items and the like; this embodiment does provide a thinner and lighter suitcase-crib combination structure as compared to the first or basic embodiment illustrated in FIGS. 1 through 7 or the second embodiment illustrated in FIG. 9 through 12. Thus, if storage space is not needed or desired, this third embodiment shown in FIG. 14 can be utilized and may be preferred by some parents since it is smaller in size and thus lighter in weight than the other two embodiments. The crib structure, as mentioned, is identical to the structure of crib 41 shown in FIG. 12 and therefore is as easily erected and taken down as crib 41. When in the folded position, the crib structure of the FIG. 14 embodiment merely folds into suitcase 70.

Figure 15:
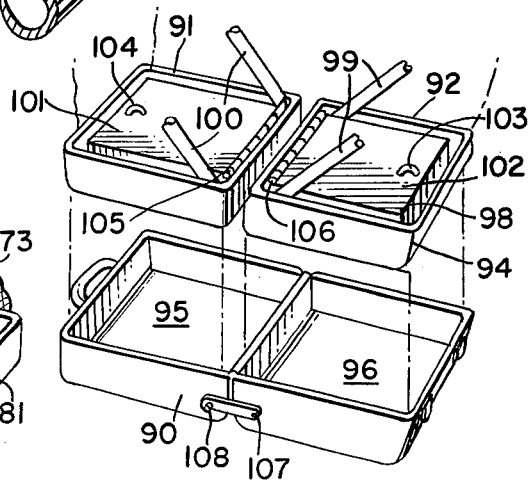
FIG. 15 shows the insert embodiment of the invention.

FIG. 15 shows a fourth embodiment of the invention. This fourth embodiment is an insert for a suitable standard or conventional suitcase 90. The insert is actually constructed as two identical parts or halves, the halves or parts 91 and 92, which are constructed to fit into the two parts 95 and 96, respectively, of suitcase 90 as indicated by the dotted lines in FIG. 15. A careful comparison of insert halves 91 and 92 with the first or basic embodiment of the invention, particularly as illustrated in FIG. 2, reveals that insert halves 91 and 92 in combination form a structure that is structurally identical to the basic embodiment shown in FIGS. 1 through 7 except outer walls 93 and 94 of parts 91 and 92, respectively, which are equivalent to the outer wall structure 2 of the basic embodiment, do not form the suitcase. Outer walls 93 and 94, when parts 91 and 92 are inserted into parts 95 and 96 of suitcase 90, abut the walls of parts 95 and 96, respectively, of suitcase 70. Thus, the walls of suitcase 70, in combination with outer walls 93 and 94, form a wall structure equivalent to outer wall structure 2 of the basic embodiment. In some cases when suitcase 90 has a suitable configuration, outer walls 93 and 94 may be eliminated entirely allowing the wall parts 95 and 96 of suitcase 90 to form the equivalent to outer wall structure 2 of the basic embodiment. If outer walls 93 and 94 are eliminated, rods 99 and 100 are pivotally secured to inner walls 97 and 98, respectively, by any suitable means. Part 91 is provided with an inner wall structure 97 that is spaced apart from outer wall structure 93 to form a channel between outer wall 93 and inner wall 97, and part 92 is provided with an inner structure 98 that is spaced apart from outer wall 94 to form a channel between inner wall 98 and outer wall 94. A crib structure identical to the crib structure of the basic embodiment illustrated in FIGS. 1 through 7 is provided. The crib structure is not shown in FIG. 15 but is illustrated by the segments of crib support rods 99 and 100. The rods 99 and 100 are pivotally secured to outer walls 92 and 91 and/or inner walls 97 and 98, respectively, by any suitable means. As in the case with the basic embodiment, the rods and crib walls fit down into the channels formed by outer wall 93 and inner wall 97 and the channel formed by outer wall 94 and inner wall 98 when the crib is folded. Since the crib is identical to the crib of the basic embodiment, the crib has telescoping rods having the hole and button lock arrangement of FIG. 13, the ropes and couplers of FIG. 16 and a pair of zippers.

Part 91 is provided with a hinged door 101 hinged by a piano type hinge 105 and part 92 is provided with a hinged door 102 hinged by a piano type hinge 106.

Pull string 104 or suitable recessed handle is provided to raise hinged door 104 and pull string 103 or suitable recessed handle is provided to raise hinged door 102. Although not visible in FIG. 15, it should be obvious from the basic embodiment that a storage compartment is located beneath each of the doors 101 and 102 and that when the crib is erected, a mattress is placed across hinged doors 101 and 102, the mattress being conveniently stored in one of the compartments.

As mentioned, part 91 fits into part 95 of suitcase 90 and part 92 fits into part 96 of suitcase 90. Any suitable means can be used to secure parts 91 and 92 inside suitcase 90. Since suitcase 90 is a conventional suitcase, it is, of course, provided with the normal suitcase handle and latches. The latch arm 107 and the latch pin 108 are fitted on suitcase 90 to lock suitcase 90 in an open position. While latch arm 107 and latch pin 108 provide a convenient locking arrangement, any suitable means can be utilized.

This insert embodiment of FIG. 15 provides a convenient embodiment for those parents who have a spare suitable suitcase and have the necessary tools to secure parts 91 and 92 inside suitcase 90 and to modify suitcase 90 by adding the latch arm 107 and pin 108 or other locking means. Of course, the erecting and taking down of the crib itself does not require any special tools. Another desirable feature of this insert embodiment is the ease with which parts 91 and 92 can be removed when a crib is no longer needed thereby restoring suitcase 90 to a regular suitcase. Any holes drilled into the body of suitcase 90 can easily be filled by any suitable material when parts 91 and 92 are removed. Of course, the crib structure can be removed from any of the embodiments when a crib is no longer needed to use the suitcase structure as a regular suitcase.

In summary, four different embodiments are disclosed. In the first or basic embodiment, compartments are provided and the crib structure has a two-piece wall structure joined by zippers in the erected position and by covered ropes having coupling means. In the second embodiment, the crib wall is one-piece thereby eliminating the zippers but at a sacrifice of storage space in the compartments for the same overall size. The third embodiment is the smallest in overall size and weight and uses a single wall crib structure but provides no storage space. The fourth embodiment provides inserts that are inserted into a conventional suitcase and is essentially identical to the basic embodiment. All the embodiments utilize telescoping rods which have the button and hole locking arrangement of FIG. 13 or some equivalent locking structure. Only the two-piece crib structure of the basic embodiment and the insert embodiment require the coupler shown in FIG. 16. All the embodiments can be provided with appropriate sleeves to accomodate a pair of stiffening rods such as the stiffening rod of FIG. 8.

While the invention has been described with reference to the four specific embodiments illustrated in the drawing, it will be obvious to those skilled in the art that various changes and modifications can be made to these embodiments without departing from the spirit and scope of the invention as set forth in claims.

I claim:

1. A suitcase-crib combination comprising:

a suitcase structure having an outer wall formed in two halves and an inner wall structure formed in two halves, said inner wall structure being spaced apart from said outer wall structure;

hinge means coupling said two halves of said inner wall structure and said two halves of said outer wall structure together to form said suitcase structure; and a folding crib structure having a pair of telescoping rods and a mesh wall structure secured to said telescoping rods, said telescoping rods being pivotally secured in the space between said inner wall structure and said outer wall structure, one of said pair of rods being pivotally secured to one of said halves of inner and or outer wall and the other of said rods being pivotally secured to the other of said halves, said telescoping rods and said mesh wall structure of said folding crib being folded into spaces formed between said inner wall structure and said outer wall structure and said suitcase being closed when said suitcase-crib combination is not in use.

2. The suitcase-crib combination as defined in claim 1 wherein a first ledge is provided on one of said two halves of said inner wall structure and a second ledge is provided on the other of said two halves of said inner wall structure and wherein a first door is secured to said one of said halves of said inner wall structure by means of a hinge and rests on said first ledge when said first door is in its closed position and a second door secured to said other half of said two halves of said inner wall structure by means of a hinge and rests on said second ledge when said second door is in its closed position, said first door covering a first storage compartment formed inside said one half of said two halves of said inner wall structure and said second door covering a second storage compartment formed inside said other half of said two halves of said inner wall structure.

3. The suitcase-crib combination as defined in claim 2 wherein the height of said inner wall structure is substantially the same height as the height of said outer wall structure.

4. The suitcase-crib combination as defined in claim 3 wherein said mesh wall of said folding crib is formed in two halves and wherein a first sleeve is provided to attach one half of said two halves of said mesh wall to a portion of one of said pair of telescoping rods, a second sleeve is secured along the entire top edge of said one half of said two halves of said mesh wall, a third sleeve is provided to attach the other half of said two halves of said mesh wall to a portion of the other of said pair of telescoping rods and a fourth sleeve is secured along the entire top edge of said other half of said two halves of said mesh wall and wherein said one half of said mesh wall has its bottom edge secured to said inner wall structure of one of said two halves of said inner wall structure and said other half of said two halves of said mesh wall has its bottom edge secured to the other of said two halves of said inner wall structure.

5. The suitcase-crib combination as defined in claim 4 wherein a first line having a coupler on one end and a mating coupler on its other end is housed inside said second sleeve and a second line having a coupler one end and a mating coupler on its other end is housed inside said fourth sleeve, said coupler of said first line mating with said mating coupler of said second line and said coupler of said second line mating with said mating coupler of said first line to attach the top edges of said two halves of said mesh wall to each other when said crib structure is in its unfolded position and wherein a pair of zippers are provided to fasten said two halves of said mesh wall together when said crib structure is in its unfolded position.

6. The suitcase-crib combination as defined in claim 5 wherein each of said pair of telescoping rods is U-shaped and a locking mechanism is provided on each of said pair of telescoping rods to lock said telescoping rods into a telescoped position when said crib structure is in its unfolded and fully erect position.

7. The suitcase-crib combination as defined in claim 6 wherein a locking mechanism is provided on said outer wall structure to lock said suitcase structure in its open position when said crib structure is in its unfolded and fully erect position.

8. The suitcase-crib combination as defined in claim 7 wherein said suitcase has a carrying handle secured to said outer wall structure and latching means secured to said outer wall structure to lock said suitcase closed when said crib structure is in its folded position.

9. The suitcase-crib combination as defined in claim 8 wherein a mattress stored in one of the said first and second storage compartments when said crib structure is folded and said suitcase structure is closed is provided to cover said first and second doors when said crib structure is in its unfolded-erect position.

10. The suitcase-crib combination as defined in claim 2 wherein the inner wall structure is shorter in height than the height of said outer wall structure.

11. The suitcase-crib combination as defined in claim 10 wherein a mattress is detachably secured to said first and second doors.

12. The suitcase-crib combination as defined in claim 11 wherein a first sleeve is provided to attach said mesh wall to one of said pair of telescoping rods, a second sleeve is provided to attach said mesh wall to the other of said pair of telescoping rods and a third sleeve having a line therein is attached along the entire top edge of said mesh wall and wherein the bottom edge of said mesh wall is secured to said inner wall structure along the entire length of said bottom edge.

13. The suitcase-crib combination as defined in claim 12 wherein said mesh wall not only fits into said spaces between said inner wall structure and said outer wall structure but also into the spaces formed between the edges of said mattress and the part of said outer wall structure that extends above said shorter inner wall structure.

14. The suitcase-crib combination as defined in claim 13 wherein each of said pair of telescoping rods is U-shaped and a locking mechanism is provided on each of said pair of telescoping rods to lock said telescoping rods into a telescoped position when said crib structure is in its unfolded and fully erect position.

15. A folding crib insert for a suitcase comprising:

a first section designed to be inserted into one half of a suitcase, said first section having an outer wall structure and an inner wall structure spaced apart from said outer wall structure, said outer wall structure having a pair of side walls, a pair of end walls and a bottom wall, said inner wall structure having one end wall and two side walls and being secured to said bottom wall of said outer wall structure such that said inner wall structure is inside said outer wall structure with a first channel being formed between said walls of said inner and outer wall structures;

a second section designed to be inserted into the other half of said suitcase, said second section having an outer wall structure and an inner wall structure spaced apart from said outer wall structure, said outer wall structure of said second section having a pair of end walls, a pair of side walls and a bottom wall and said inner wall structure of said second section having one end wall and a pair of side walls and being secured to said bottom wall of said outer wall structure of said second section with a second channel being formed between said walls of said inner and outer wall structures;

a first telescoping rod pivotally secured in said first channel;

a second telescoping rod pivotally secured in said second channel;

a mesh crib wall having a first half and a second half, the bottom edge of said first half of said mesh crib wall being secured to said inner wall structure of said first section and the bottom edge of said second half of mesh crib wall being secured to said inner wall of said second section;

means to secure a portion of said first half of said mesh wall to a portion of said first telescoping rod;

means to secure a portion of said second half of said mesh wall to said second telescoping rod;

a first hinged door covering said inner wall structure of said first section;

a second hinged door covering said inner wall structure of said second section; and means to secure said first half of said mesh wall to said second half of said mesh wall when said first and second telescoping rods are extended and said first and second halves of said mesh wall are unfolded to form an erected crib, said first telescoping rod and said first half to said mesh wall being housed in said first channel when said crib is folded and said second telescoping rod and said second half of said mesh wall being housed in said second channel when said crib is folded.

16. A folding crib insert for a suitcase as defined in claim 15 wherein said outer wall structure of said first section is formed by the wall of one half of said suitcase and said outer wall structure of said second section is formed by the wall of the other half of said suitcase.

17. A suitcase-crib combination comprising:

a suitcase structure having an outer wall formed in two halves and an inner wall structure formed in two halves, said inner wall structure being spaced apart from said outer wall structure;

hinge means coupling said two halves of said inner wall structure and said two halves of said outer wall structure together to form said suitcase structure; and a folding crib structure having a pair of supports and a mesh wall structure secured to said supports, said supports being pivotally secured in the space between said inner wall structure and said outer wall structure, one of said pair of supports being pivotally secured to one of said halves of inner and or outer wall and the other of said pair of supports being pivotally secured to the other of said halves, said supports and said mesh wall structure of said folding crib being folded into spaces formed between said inner wall structure and said outer wall structure so that said suitcase can be closed when said suitcase-crib combination is not in use.

* * * * *